US012409365B2

(12) United States Patent
Culp

(10) Patent No.: US 12,409,365 B2
(45) Date of Patent: Sep. 9, 2025

(54) SWIM AID WITH ADJUSTABLE ARMBANDS

(71) Applicant: The Coleman Company, Inc., Wichita, KS (US)

(72) Inventor: Yiyun Culp, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 181 days.

(21) Appl. No.: 17/766,567

(22) PCT Filed: Oct. 1, 2020

(86) PCT No.: PCT/US2020/053711

§ 371 (c)(1),
(2) Date: Apr. 5, 2022

(87) PCT Pub. No.: WO2021/071729

PCT Pub. Date: Apr. 15, 2021

(65) Prior Publication Data

US 2024/0100398 A1 Mar. 28, 2024

Related U.S. Application Data

(60) Provisional application No. 62/911,486, filed on Oct. 7, 2019.

(51) Int. Cl.
*A63B 31/12* (2006.01)

(52) U.S. Cl.
CPC ..... *A63B 31/12* (2013.01); *A63B 2225/605* (2013.01)

(58) Field of Classification Search
CPC ..... A63B 31/12; A63B 2225/605
See application file for complete search history.

(56) References Cited

U.S. PATENT DOCUMENTS

| | | | | |
|---|---|---|---|---|
| 2008/0160849 | A1 | 7/2008 | Steger | |
| 2015/0064999 | A1 | 3/2015 | Kazazian et al. | |
| 2020/0070940 | A1* | 3/2020 | de Grasse | B63C 9/11 |

FOREIGN PATENT DOCUMENTS

| | | | | |
|---|---|---|---|---|
| DE | 3239929 | A * | 5/1984 | B63C 9/135 |
| KR | 1020060049588 | A | 5/2006 | |
| KR | 200478297 | Y1 | 9/2015 | |
| KR | 2020150004406 | U | 12/2015 | |

* cited by examiner

*Primary Examiner* — Stephen P Avila
(74) *Attorney, Agent, or Firm* — Husch Blackwell LLP

(57) ABSTRACT

A swim aid comprising a torso flotation pad, an attachment member, a right armband flotation pad and a left armband flotation pad. The right armband flotation pad is operatively connected to the torso flotation pad and includes an opening for receiving the right arm of a wearer. The left armband flotation pad is also operatively connected to the torso flotation pad and includes an opening for receiving the left arm of a wearer. At least one of the right or left armband flotation pads includes elastic material for expanding and compressing the armband flotation pads on the wearer's arm, reducing the need for buckles or straps.

16 Claims, 2 Drawing Sheets

SWIM AID WITH ADJUSTABLE ARMBANDS

CROSS-REFERENCE TO RELATED APPLICATIONS

This Application is a National Stage Entry of International Application No. PCT/US2020/053711, filed on Oct. 1, 2020, entitled "Swim Aid with Adjustable Armbands," which claims priority to U.S. Provisional Patent Application Ser. No. 62/911,486, filed on Oct. 7, 2019, entitled "Swim Aid with Adjustable Armbands," the entire disclosures of which are incorporated herein by reference.

FIELD OF THE INVENTION

The present invention is generally directed to a swim aid and more particularly to a swim aid having adjustable armbands.

BACKGROUND

Swim aids, whether characterized as life vests, personal flotation devices, or otherwise, are used by children and adults alike in order to increase buoyancy in bodies of water. Children often wear armbands that may be inflatable vinyl film chambers. Such armbands may be donned by sliding the armbands over a child's upper arms. Such armbands are prone to come off unexpectedly during a child's normal water activity, such as when a child jumps in water with arms over his or her head.

In order to provide an improved swim aid that is also U.S. Coast Guard approved, the swim aid which was the subject of U.S. patent application Ser. No. 11/616,308 had a retention member for operatively connecting armband flotation pads about the wearer. The swim aid of that prior application, however, provides for non-adjustable arm bands. As such, the arm bands of that swim aid do not fit wearers having various sized arms. Other arm bands used in other prior art swim aids may be adjustable by buckles, straps, or the like. Such adjustment mechanisms, however, may be difficult to operate, especially when hands, fingers, and/or the adjustment mechanisms themselves are wet.

SUMMARY OF THE INVENTION

A swim aid is provided that includes adjustable armbands. More particularly, the adjustable armbands may include elastic elements that make the armbands automatically conform to the size of a wearer's arm, without the need for the difficult adjustments that may be associated with armbands adjusted by buckles, straps, and the like. Other and further objects of the invention, together with the features of novelty appurtenant thereto, will appear in the course of the following description.

One embodiment of the invention is a swim aid for use by the wearer during swimming or other water-based activities. The swim aid includes a torso flotation pad that functions as a central hub of the device, having a first end and a second end. The torso flotation pad may be constructed from a closed cell foam or other suitable material that provides buoyancy to the wearer. An attachment member may further be incorporated for securing the torso flotation pad to the torso of the wearer. In one embodiment the attachment member has a first part operatively connected to the first end of the torso flotation pad and a second part operatively connected to the second end of the torso flotation pad. The first part of attachment member is adapted and configured to be releasably attached to the second part, wherein the torso flotation pad is securable around the wearer's torso. However, in other embodiments, an attachment member may be configured to permanently attach the first and second end of the torso flotation pad.

The swim aid further comprises a right adjustable armband pad, wherein the right adjustable armband pad may be constructed from the same closed cell foam as torso flotation pad. The right adjustable armband pad is operatively connected to the torso flotation pad, and has a right opening for receiving the right arm of a wearer. The swim aid further comprises a left adjustable armband pad, wherein the left adjustable armband pad may be constructed from the same closed cell foam as the torso flotation pad and the right adjustable armband pad. The left adjustable armband flotation pad is also operatively connected to the torso flotation pad, and has a left opening for receiving the left arm of a wearer.

The adjustable armband flotation pads each may have a varying thickness, with the adjustable armband flotation pads being thicker on the outside of the wearer's arm than on a wearer's underarm. The torso flotation pad and the adjustable armbands may further comprise a fabric cover. The fabric may form a retention member to operatively connect the torso flotation pad to the adjustable armband flotation pads.

The interior portion of one or both adjustable armband pads is preferably lined with elastic material. Because of this elastic material, each of the adjustable armband pads may alternate between a relaxed state or expanded state. When the elastic material is in the expanded state, the opening of an armband pad may get larger to facilitate donning the swim aid. Once a wearer has placed their arm through the armband opening to don the swim aid, the elastic material may compress. This compression preferably causes the adjustable armband pads to form a tight fit on the wearer's arms. When a wearer is ready to remove the swim aid, the wearer (or a parent, family member, or other individual) may re-expand the elastic material and remove the wearer's arms from the openings and continuing the process of taking off the swim aid. The adjustable armband pads preferably eliminate the need for a wearer or another individual such as a parent or family member from having to use buckles, straps, or the like to adjust the fit of an armband pad.

BRIEF DESCRIPTION OF THE SEVERAL VIEWS OF THE DRAWING

In the accompanying drawings, which form a part of the specification and are to be read in conjunction therewith, in which like reference numerals are used to indicate like or similar parts in the various views.

For a better understanding of the present invention, reference may be made to the following accompanying drawings.

DESCRIPTION OF THE INVENTION

Figure 1:
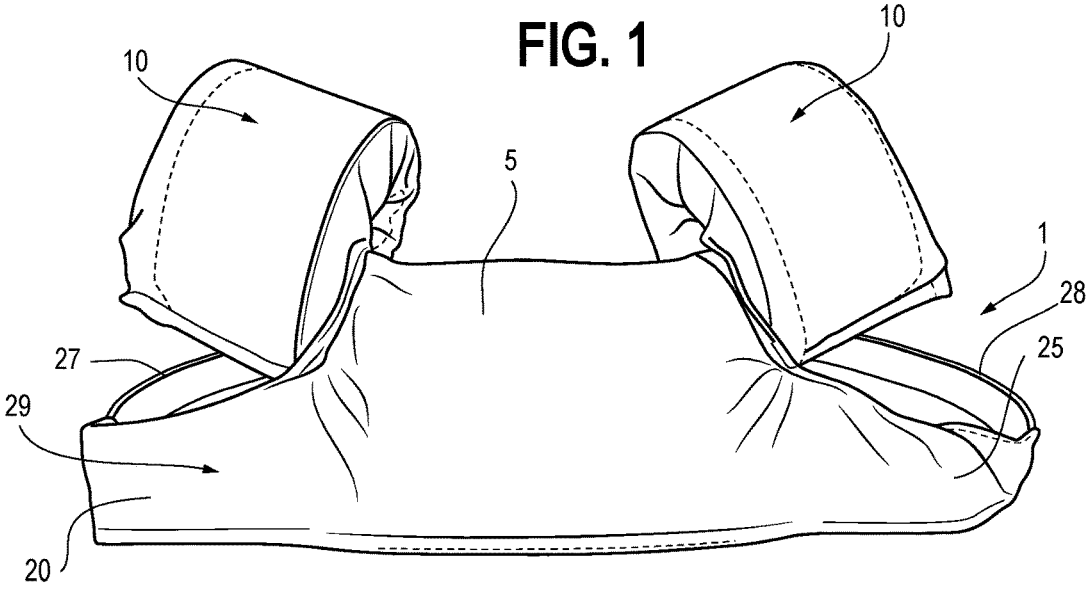
FIG. 1 is a front elevation view of a swim aid with adjustable armbands constructed according to the teachings of the invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be appreciated that any dimensions included in the drawing figures are simply provided as examples and dimensions, other than those provided therein, which are also within the scope of the invention.

The following detailed description of the invention references specific embodiments in which the invention can be practiced. The embodiments are intended to describe aspects of the invention in sufficient detail to enable those skilled in the art to practice the invention. Other embodiments can be utilized, and changes can be made without departing from the scope of the present invention. The present invention is defined by the appended claims and the description is, therefore, not to be taken in a limiting sense and shall not limit the scope of equivalents to which such claims are entitled.

Figure 2:
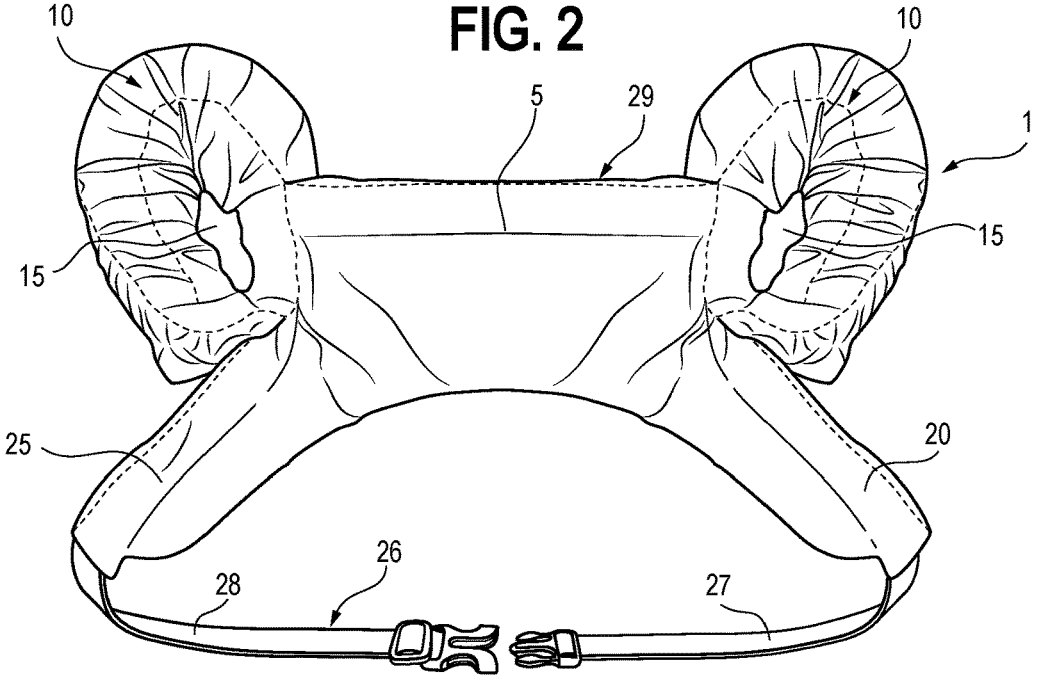
FIG. 2 is a top plan view of the swim aid with adjustable armbands of FIG. 1.
Figure 3:
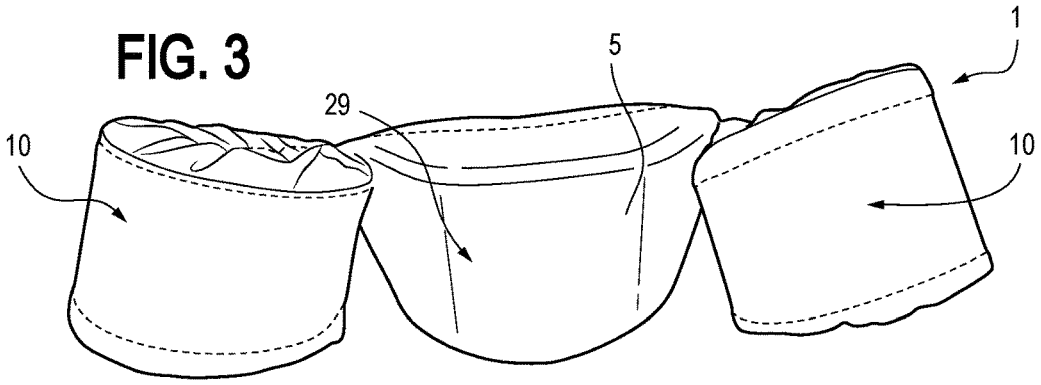
FIG. 3 is an alternative front elevation view of the swim aid with adjustable armbands of FIGS. 1 and 2.

As illustrated in FIGS. 1-3, a swim aid 1 is provided that includes a torso flotation pad 5 and each of a right and left adjustable armband pads 10 operatively connected to the torso flotation pad 5. Each of right and left adjustable armband pads 10 includes an opening 15 (see FIG. 2) for receiving the arm of a wearer (not illustrated). The adjustable armband pads 10 may have uniform or varying thicknesses, and they may be thicker on the outside of a wearer's arm than on a wearer's underarm.

In certain embodiments of the present invention, torso flotation pad 5 may be configured with the design of the torso flotation pad disclosed in U.S. Patent Publication No. 2008/0160849, entitled "Personal Flotation Device", the entire disclosure of which is incorporated herein by reference. The torso flotation pad 5 may be constructed of any suitable material such as a closed cell foam, or another low density polyethene foam, however, it will be appreciated that any suitable material now known or yet to be discovered may be used to provide buoyancy to the wearer during operation. Additionally, torso flotation pad 5 may be a single pad (as shown in the Figures) or torso flotation pad 5 may include multiple layers that are all similarly sized and arranged to create a generally arcuate shape and formed to accommodate the torso of the wearer. In one embodiment and as illustrated in FIGS. 1-2, torso flotation pad 5 also may include a first end 20 and a second end 25.

An attachment member 26 may extend each of the first end 20 and the second end 25 thereby connecting the first end 20 and the second end 25 together. In the illustrated embodiment, attachment member 26 may be an adjustable strap having a first connector 27 (e.g., a female or male buckle) operatively connected to the first end 20 and a second connector 28 (e.g., the other of a female or male buckle) operatively connected to the second end 25. The first connector 27 may be adapted and configured to be releasably attached to the second connector 28, so the torso flotation pad 5 is securable around the wearer's torso. As illustrated in FIG. 2, the attachment member 26 may be located proximate to the wearer's back; however, it can be envisioned that attachment member 26 may be located in other locations proximate to the wearer.

It will be appreciated that other methods of securing the first end 20 and the second end 25 may be utilized, and that in alternate embodiments, the first end 20 and the second end 25 may be permanently affixed, such that torso flotation pad 5 consists of one continuous unit. In such an alternative embodiment, closed cell foam or other suitable material may be used in the entire circumference of the torso flotation pad 5 or may be placed intermittently throughout the torso flotation pad 5. It will be appreciated that swim aid 1 may be used by both child and adult users of varying sizes, and as such, the size of swim aid 1, torso flotation pad 5, attachment member 26, and adjustable armband pads 10 may correspondingly vary in size to accommodate the relative size of the wearer. As illustrated in FIGS. 1-3, the torso flotation pad 5 may further be covered in fabric 29.

Like the torso flotation pad 5, the adjustable armband pads 10 may also be constructed from closed cell foam or other suitable material to provide additional buoyancy to the wearer. Additionally, each of the adjustable armband pads 10 may be a single pad, or alternatively include multiple layers of pads that are similarly sized, the number of which may vary based on the embodiment of adjustable armband pad 10. Each of adjustable armband pad 10 may be wrapped with fabric 29, or other cover material, similar to the torso flotation pad 5. In alternative embodiments, only one of each of the adjustable armband pads may be covered with fabric 29 or other suitable covering.

As illustrated in FIGS. 1-3, a right and left adjustable armband pad 10 may be operatively connected to torso flotation pad 5, located at opposite sides of torso flotation pad, and positioned generally near or at the top of the torso flotation pad 5. In other words, the operative connection point between torso flotation pad 5 and each of the right and left adjustable armband pads 10 can be located proximate or above the armpit of the wearer. Fabric 29 may be used to form a retention member to operatively connect the torso flotation pad to each of the adjustable armband pads 10.

As used herein, fabric 29 or corresponding material can be sewn, stitched, or otherwise connected to the torso flotation pad 5. Furthermore, the same fabric 29 or corresponding material, or alternatively a different material can be sewn, stitched, or otherwise connected to either or both of the adjustable armband pads 10. Accordingly, fabric 29 can be applied to either of or both of torso flotation pad 5 and adjustable armband pads 10. It will be appreciated that images and logos can be imparted on fabric 29 for marketing purposes.

Figure 4:
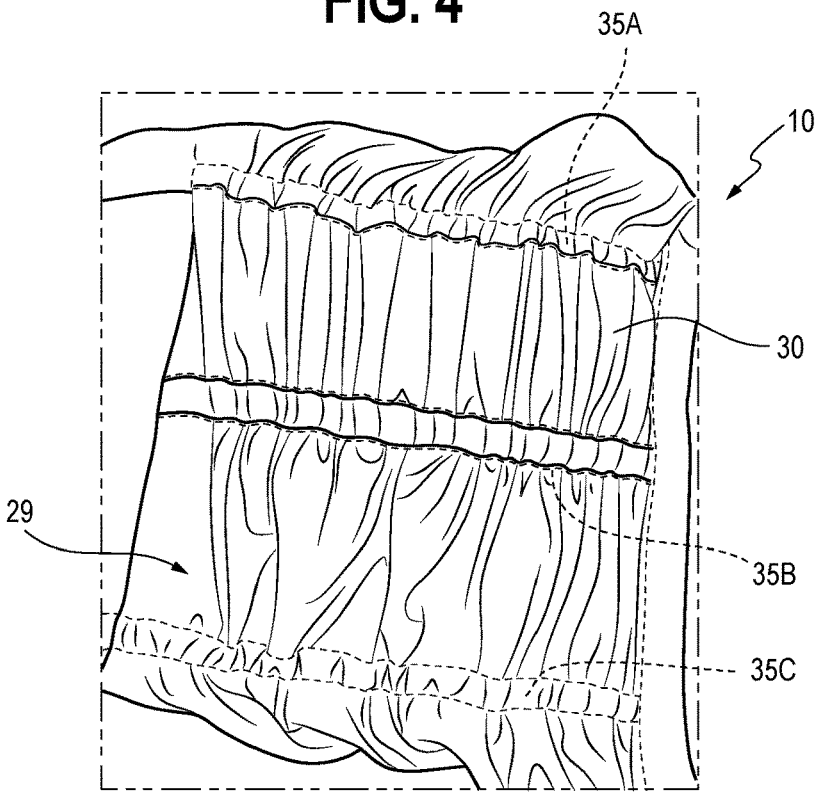
FIG. 4 illustrates an interior portion of the adjustable armband of the swim aid of FIGS. 1-3 in a compressed form.
Figure 5:
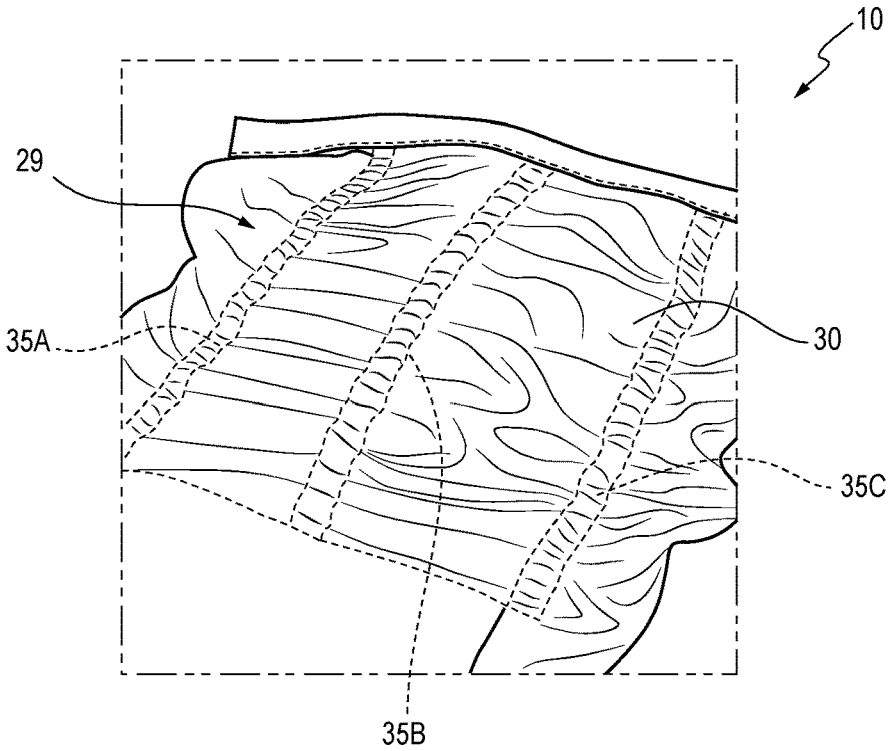
FIG. 5 illustrates an interior portion of the adjustable armband of FIG. 4 in an expanded form.

The adjustable armband pads 10 are illustrated in FIGS. 4 and 5, and more particularly, an interior portion 30 of one of the adjustable armband pads 10 is illustrated in FIGS. 4 and 5. The interior portion 30 of one or both of adjustable armband pads 10 may be lined with elastic strips, lining, or other material, for making the adjustable armband pads 10 able to elastically expand and contract. In the illustrated embodiment, three strips of elastic material 35A, 35B, and 35C are illustrated at the upper, middle, and lower portions, respectively, of interior portion 30 of the adjustable armband pads 10. The three strips of elastic material 35A, 35B, and 35C may line the entire circumferential interior portion 30 of the adjustable armband pad 10. The elastic material 35A, 35B, 35C may be covered by fabric 29, as it is in FIGS. 4 and 5. In alternative embodiments, more or less elastic material 35A, 35B, 35C may be provided in the adjustable armband pads 10. In other alternatives, the three strips of elastic material 35A, 35B, and 35C may be replaced by more or fewer elastic strips, elastic cords or elastic panels.

Because the adjustable armband pads 10 include elastic material 35A, 35B, 35C, they may alternate between a relaxed state (as illustrated in FIG. 4) or expanded state (as illustrated in FIG. 5). When the elastic material 35A, 35B, 35C is in the expanded state, the opening 15 of an adjustable armband pad 10 may get larger to facilitate donning the swim aid 1. Once a wearer has placed their arm through the opening 15 to don the swim aid 1, the elastic material 35A, 35B, 35C may automatically compress. This compression preferably causes the adjustable armband pad 10 to form a tight fit on the wearer's arms. When a wearer is ready to doff the swim aid, the wearer (or a parent, family member, or other individual) may re-expand the elastic material 35A, 35B, 35C and remove the wearer's arm from one of the openings 15. This process can be repeated until both of the wearer's arms have been removed from adjustable armband pads 10. Once both arms have been removed from the adjustable armband pads 10, the wearer can continue the process of taking off the swim aid 1 by removing torso flotation pad 5.

In operation, the wearer may place a first arm through a first opening 15 in either of the adjustable armband pads 10. The wearer may then place a second arm through a second opening 15 in the other of the adjustable armband pads 10. It will be appreciated that just prior to the wearer inserting their arm into the adjustable armband pad 10, the adjustable armband pad 10 will be in its relaxed state.

As the wearer inserts their arm into the opening 15 of either of the two adjustable armband pads 10, the elastic material 35A, 35B, 35C will correspondingly expand to accommodate the size of the wearer's arm. This may be achieved through manually grabbing adjustable armband pads 10 and applying an outward pressure, or through enough pressure generated as the arm is inserted into the adjustable armband opening 15. In either method, it will be appreciated that adjustable armband pad 10 may expand in size during the insertion of an arm. This process may be repeated until both arms of the wearer are inserted into each of the adjustable armband pad 10. It will be appreciated that in the process of placing the wearer's arms in the adjustable armband pads 10, that torso flotation pad 5 will also be placed proximate to the upper portion of the wearer's torso. The wearer (or a parent, family member, or other individual) may then secure the attachment member 26 connecting the first end 20 to the second end 25, securing torso flotation pad 5 to the wearer.

The adjustable armband pads 10 preferably eliminate the need for a wearer or another individual such as a parent or family member from having to use buckles, straps, or the like to adjust the fit of an adjustable armband pad 10. In at least some embodiments, the elastic material 35A, 35B, 35C may be replaced with a different material than conventional elastic that is able to substantially contract and expand.

It will be further appreciated that in place of the attachment member 26, torso flotation pad 5 may instead incorporate elastic material (mirroring the elastic material 35A, 35B, and 35C) such that torso flotation pad 5 is also adjustable without the use of an adjustable strap or attachment member 26. In such an embodiment, first end 20 and second end 25 may be connected by an elastic material, similar to the elastic material 35A, 35B, and 35C found in the interior portion 30 of adjustable armband pads 10. In such an embodiment, torso flotation pad 5 may expand as the wearer puts torso flotation pad 5 on and will then constrict back to its relaxed state after donning. Alternatively, it will be appreciated that in an even further embodiment in which torso flotation pad 5 comprises elastic material connecting first end 20 and second end 25, that swim aid 1 may comprise a sleeveless, or vest like design, comprising torso flotation pad 5, but without one or more of adjustable armband pads 10.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles, and scope of the present invention.

Many changes, modifications, variations, and other uses and applications of the present invention will, however, become apparent to those skilled in the art after considering the specification and the accompanying drawings. All such changes, modifications, variations, and other uses and applications which do not depart from the spirit and scope of the invention are deemed to be covered by the invention, which is limited only by the claims which follow.

From the foregoing, it will be seen that this invention is one well adapted to attain all the ends and objects hereinabove set forth together with other advantages which are inherent to the structure and method. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is, therefore, contemplated that other modifications and applications, or equivalents thereof, will occur to those skilled in the art. The terms "having" and "including", and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A swim aid for use by a wearer, comprising:

a torso flotation pad;

a first armband pad operatively connected to the torso flotation pad and having an opening for receiving a first arm of the wearer;

wherein the first armband pad includes;

a fabric cover; and elastic material covered by the fabric cover for expanding and compressing the first armband pad;

wherein the swim aid includes a second armband pad operatively connected to the torso flotation pad and having an opening for receiving a second arm of the wearer;

wherein the second armband pad includes:

the fabric cover; and elastic material covered by the fabric cover for expanding and compressing the second armband pad; and wherein each of the first and second armband pads includes two or more strips of elastic material covered by the fabric cover and lining a circumferential interior portion of the first and second armband pads.

2. The swim aid of claim 1, further comprising:

the torso flotation pad having a first end and a second end;

an attachment member having a first part operatively connected to the first end and a second part operatively connected to the second end; and the first part of the attachment member adapted and configured to be releasably attached to the second part of the attachment member, and wherein when the first part of attachment member is attached to the second part of the attachment member, the torso flotation pad is securable around a wearer's torso.

3. The swim aid of claim 1, further comprising:

the torso flotation pad having a first end and a second end;

an attachment member having a first part operatively connected to the first end of the torso flotation pad and a second part operatively connected to the second end of the flotation pad, and wherein the attachment member includes elastic material for expanding and compressing the attachment member, and when the attachment member is compressed, the torso flotation pad is securable around a wearer's torso.

4. The swim aid of claim 1, further comprising an attachment member operatively connected to the torso flotation pad, wherein the attachment member is positioned proximate the wearer's back.

5. The swim aid of claim 1, wherein the torso flotation pad and the first and second armband pads include the fabric cover.

6. The swim aid of claim 5, wherein the fabric cover is used to form a retention member to operatively connect the torso flotation pad to the first and second armband pads.

7. The swim aid of claim 1, wherein, for each of the first and second armband pads, the two or more strips of elastic material line the entire circumferential interior portion.

8. A swim aid for use by a wearer, comprising:

a torso flotation pad;

a first armband pad operatively connected to the torso flotation pad and having an opening for receiving a first arm of a wearer; and a second armband pad operatively connected to the torso flotation pad and having an opening for receiving a second arm of a wearer; and wherein the first and second armband pads include elastic material covered by a fabric cover for expanding and compressing the first and second armband pads; and wherein each of the first and second armband pads includes two or more strips of elastic material covered by the fabric cover and lining a circumferential interior portion of the first and second armband pads.

9. The swim aid of claim 8, further comprising:

the torso flotation pad having a first end and a second end;

an attachment member having a first part operatively connected to the first end and a second part operatively connected to the second end; and the first part of the attachment member adapted and configured to be releasably attached to the second part of the attachment member, and wherein when the first part of attachment member is attached to the second part of the attachment member, the torso flotation pad is securable around a wearer's torso.

10. The swim aid of claim 9, wherein the attachment member is positioned proximate the wearer's back.

11. The swim aid of claim 8, wherein the torso flotation pad and the first and second armband pads include the fabric cover.

12. The swim aid of claim 11, wherein the fabric cover is used to form a retention member to operatively connect the torso flotation pad to the first and second armband pads.

13. The swim aid of claim 8, wherein, for each of the first and second armband pads, the two or more strips of elastic material line the entire circumferential interior portion.

14. The swim aid of claim 8, wherein the first and second armband pads include elastic panels covered by the fabric cover and located in an interior portion of the first and second armband pads.

15. A swim aid for use by a wearer, comprising:

a torso flotation pad;

a first armband pad operatively connected to the torso flotation pad and having an opening for receiving a first arm of a wearer; and a second armband pad operatively connected to the torso flotation pad and having an opening for receiving a second arm of a wearer;

wherein the first and second armband pads include elastic material covered by a fabric cover for expanding and compressing the first and second armband pads; and wherein when the swim aid is donned, the elastic material of the first and second armband pads is configured to automatically transition between a compressed state and an expanded state such that the first and second armband pads conform to and tightly fit the first and second arms of the wearer.

16. A swim aid for use by a wearer, comprising:

a torso flotation pad;

a first armband pad operatively connected to the torso flotation pad and having an opening for receiving a first arm of the wearer;

wherein the first armband pad includes:

a fabric cover; and elastic material covered by the fabric cover for expanding and compressing the first armband pad; and wherein when the swim aid is donned, the elastic material is configured to automatically transition between a compressed state and an expanded state such that the first armband pad conforms to and tightly fits the first arm of the wearer.

* * * * *